US008667676B2

(12) United States Patent
Sviben

(10) Patent No.: US 8,667,676 B2
(45) Date of Patent: Mar. 11, 2014

(54) METHOD OF STRANDED ELECTRICAL WIRE CONNECTION

(76) Inventor: Jeremy Sviben, Medford Lakes, NJ (US)

( * ) Notice: Subject to any disclaimer, the term of this patent is extended or adjusted under 35 U.S.C. 154(b) by 1120 days.

(21) Appl. No.: 12/653,472

(22) Filed: Dec. 15, 2009

(65) Prior Publication Data

US 2010/0146786 A1 Jun. 17, 2010

Related U.S. Application Data

(60) Provisional application No. 61/201,919, filed on Dec. 16, 2008.

(51) Int. Cl.
*H01R 43/00* (2006.01)

(52) U.S. Cl.
USPC ..... 29/868; 29/869; 29/871; 29/873; 174/84 C

(58) Field of Classification Search
USPC ..... 29/868, 869, 871–873; 174/84 C
See application file for complete search history.

(56) References Cited

U.S. PATENT DOCUMENTS 2,724,098 A * 11/1955 Bergan ..... 439/879
4,391,661 A * 7/1983 Izraeli ..... 156/49
5,749,756 A * 5/1998 Vockroth et al. ..... 439/879
6,658,735 B2 * 12/2003 Ito ..... 29/868
7,188,415 B2 * 3/2007 Robinson et al. ..... 29/868
7,896,712 B2 * 3/2011 Cecil et al. ..... 439/730
2010/0096158 A1 * 4/2010 Wheatley ..... 174/68.1
2010/0146786 A1 * 6/2010 Sviben ..... 29/869

* cited by examiner

*Primary Examiner* — Minh Trinh

(74) *Attorney, Agent, or Firm* — Stuart M. Goldstein

(57) ABSTRACT

A method of stranded electrical wire connection involves stripping the insulation off the ends of stranded wire, inserting a metallic barrel member over the ends of the wire, applying ratcheting pressure to the barrel member to compress the barrel member over each end of the stranded wires, and then applying constant, irreversible ratcheting pressure to the wire containing barrel to substantially eliminate the spaces between the strands and to form a permanent barrel to wire connection between the lengths of wire. A shrink tube with an inner layer of adhesive is positioned over the permanent connection and the shrink tube, with its layer of adhesive, is heated, thus substantially eliminating any space between the shrink tube and the permanent connection. Utilizing the method of the present invention results in a permanent, waterproof connection between the stranded wire which eliminates all expansion and contraction within the permanent connection during use.

11 Claims, 4 Drawing Sheets

METHOD OF STRANDED ELECTRICAL WIRE CONNECTION

RELATED APPLICATION

The herein application claims the benefit of provisional application Ser. No. 61/201,919 filed on Dec. 16, 2008.

BACKGROUND OF THE INVENTION

A variety of methods are currently employed for attaching lengths of stranded electrical wire. Most of these methods require that a portion of the insulation covering the end of the wire be stripped to expose the conductor strands of the wire. The exposed strands are then twisted, compressed, or otherwise manually secured together by means of a crimping tool, pliers, or even by hand. However, these methods, fundamentally, will not produce a secure stranded wire to stranded wire connection which will withstand stress forces which the wire connection experiences during use. Such wire connections are not secure and will eventually fail as a result of the naturally occurring conditions to which the connections are exposed.

More specifically, wires connected in this manner, when energized and then de-energized will create a heating and cooling effect, as the flow of current runs through the wires and is then turned off. This constant energizing and de-energizing of the wires causes intermittent expansion and then contraction of the wires. The endless cycle of expansion and contraction causes a constantly deteriorating effect on the wires which literally will destroy them in a relatively short period of time.

SUMMARY OF THE INVENTION

It is thus the object of the present invention to provide a method of stranded electrical wire connection which drastically reduces and eliminates the damaging heating and cooling effect in the connections, due to normal operation to the wires, yet caused by inconsistent tightening and crimping techniques. The method employs a ratcheting crimping tool which applies a designated, constant ratcheting compression to permanently connect stranded 8-18 gauge wires from lighting fixtures, including LED lamps, florescent lamps, and feed/power sources, by eliminating the spaces between the wire strands and thus eliminating the possibility of expansion and contraction between the strands during use. Application of the herein method eliminates the inconsistent and loose connections which result in ultimate untimely failure of electrical connections. The method is designed for use with stranded wire only, in low voltage, i.e. 30 volts or less, applications.

These and other objects are accomplished by the present invention, the method of stranded electrical wire connection which involves stripping the insulation off the ends of stranded wire, inserting a metallic barrel member over the ends of the wire, applying ratcheting pressure to the barrel member to compress the barrel member over each end of the stranded wires, and then applying constant, irreversible ratcheting pressure to the wire containing barrel to substantially eliminate the spaces between the strands and to form a permanent barrel to wire connection between the lengths of wire. A shrink tube with an inner layer of adhesive is positioned over the permanent connection and the shrink tube, with its layer of adhesive, is heated, thus substantially eliminating any space between the shrink tube and the permanent connection. Utilizing the method of the present invention results in a permanent, waterproof connection between the stranded wire which eliminates all expansion and contraction within the permanent connection during use.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
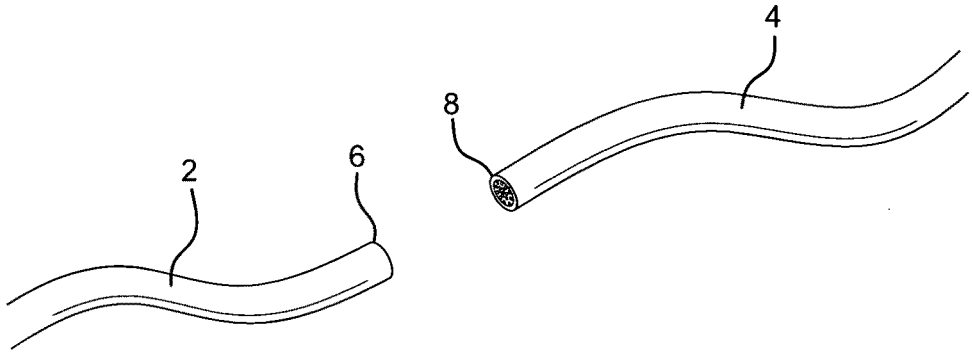
FIG. 1 shows the two lengths of stranded electrical wire to be connected in accordance with the method of the present invention.
Figure 2:
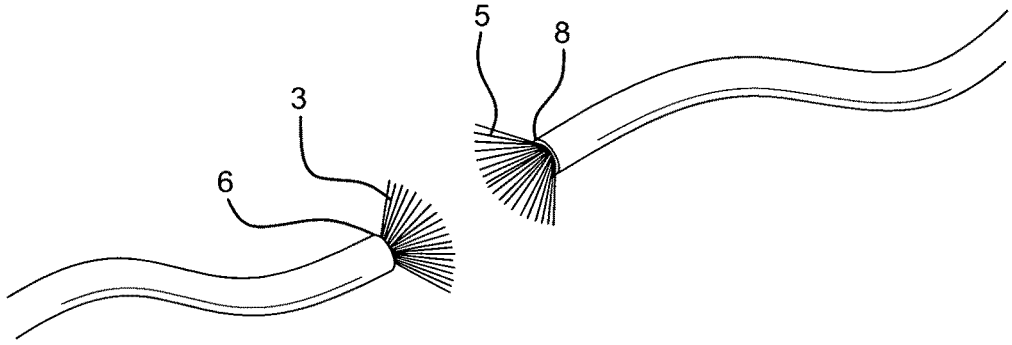
FIG. 2 shows the first step of the method of the present invention, in which insulation has been removed.
Figure 3:
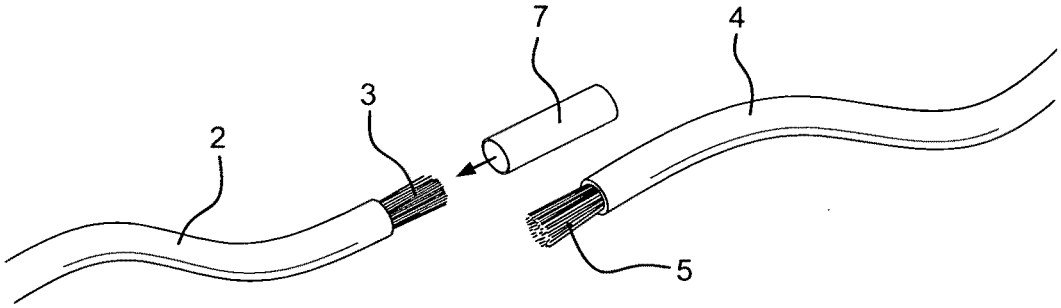
FIG. 3 shows the strands of the lengths of wire after they are manually pressed together.
Figure 4:
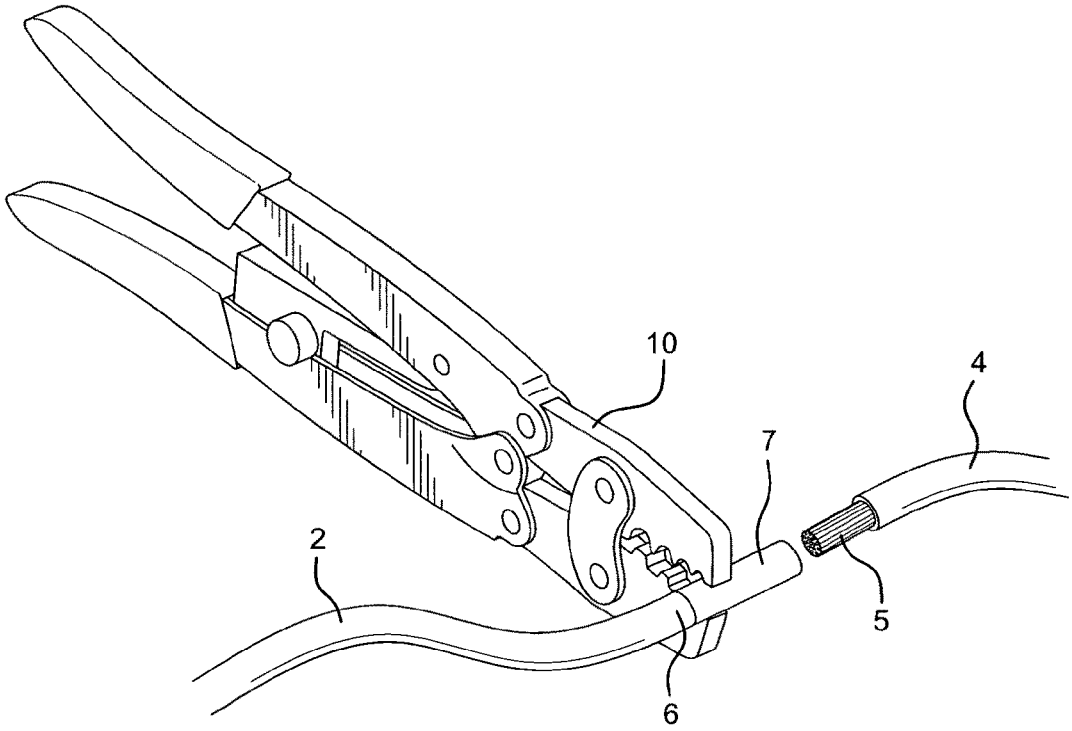
FIG. 4 shows the initial barrel member crimping step of the method of the present invention.

The object of the invention is to permanently connect lengths of stranded electrical wire in order to eliminate the possibility of expansion and contraction between the strands of the wire and thus ensure for the longevity of the connection. As seen in FIG. 1, insulated covered electrical stranded wires 2 and 4 with conductor strands 3 and 5, are provided for connection. Insulation is stripped off ends 6 and 8 of wires 2 and 4 to expose strands 3 and 5, as seen in FIG. 2. Strands 3 and 5 are initially gathered and manually pressed together. FIG. 3.

Metallic barrel member 7, made of tin coated copper or equivalent material, is inserted over pressed strands 3 (FIG. 3) and, by use of ratcheting crimper tool 10, constant, irreversible ratcheting pressure is applied to the barrel member to tightly compress the strands at end 6 of wire 2 together. It has been found that ratcheting pressure, accomplished in distinct, irreversible ratcheting intervals, will tightly compress the strands of the wire such that the spaces between the strands and the barrel member are substantially eliminated. A ratcheting crimper tool is used, since once the crimping process begins, this tool provides a constant pressure which will not reverse until the connection has been fully compressed or the tool's release button is pushed. This creates a consistent, increasingly tight, compressed wire connection regardless of the strength of the installer.

Figure 5:
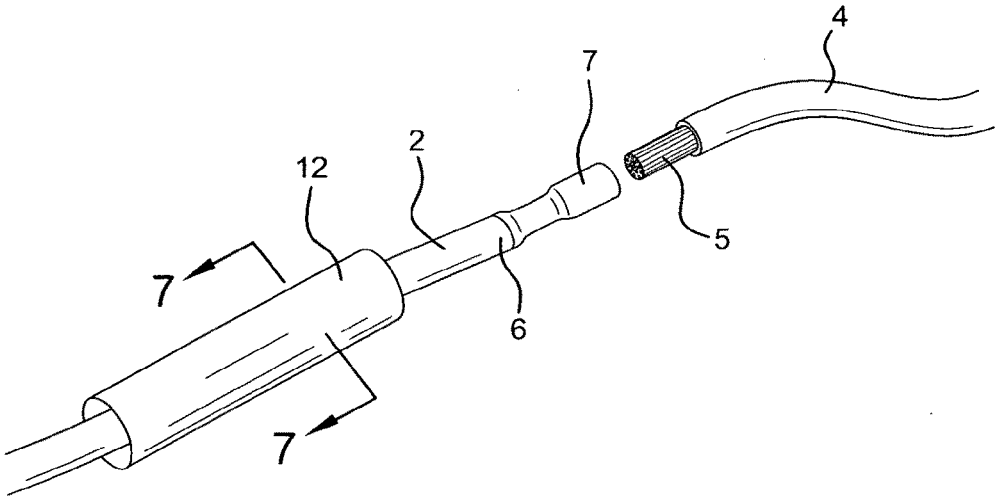
FIG. 5 shows the barrel member partially crimped around the strands of one end of one of the lengths of wire to be connected.
Figure 7:
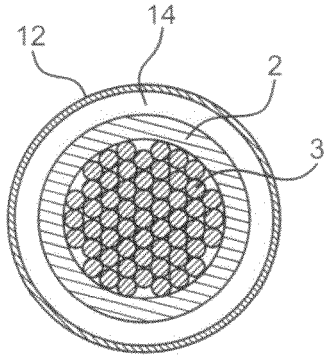
FIG. 7 is a cross sectional view of the shrink tube, taken from FIG. 5.

After strands 3 are sufficiently compressed within barrel member 7, shrink tube 12 is inserted over wire 2, as seen in FIG. 5. Shrink tube 12 is made of a rubberized material and, as best seen in FIG. 7, comprises an inner layer of adhesive 14.

The adhesive is a thermoplastic type adhesive, or its equivalent, capable of being dissolved when heated to form a tight, gasket like seal.

Figure 6:
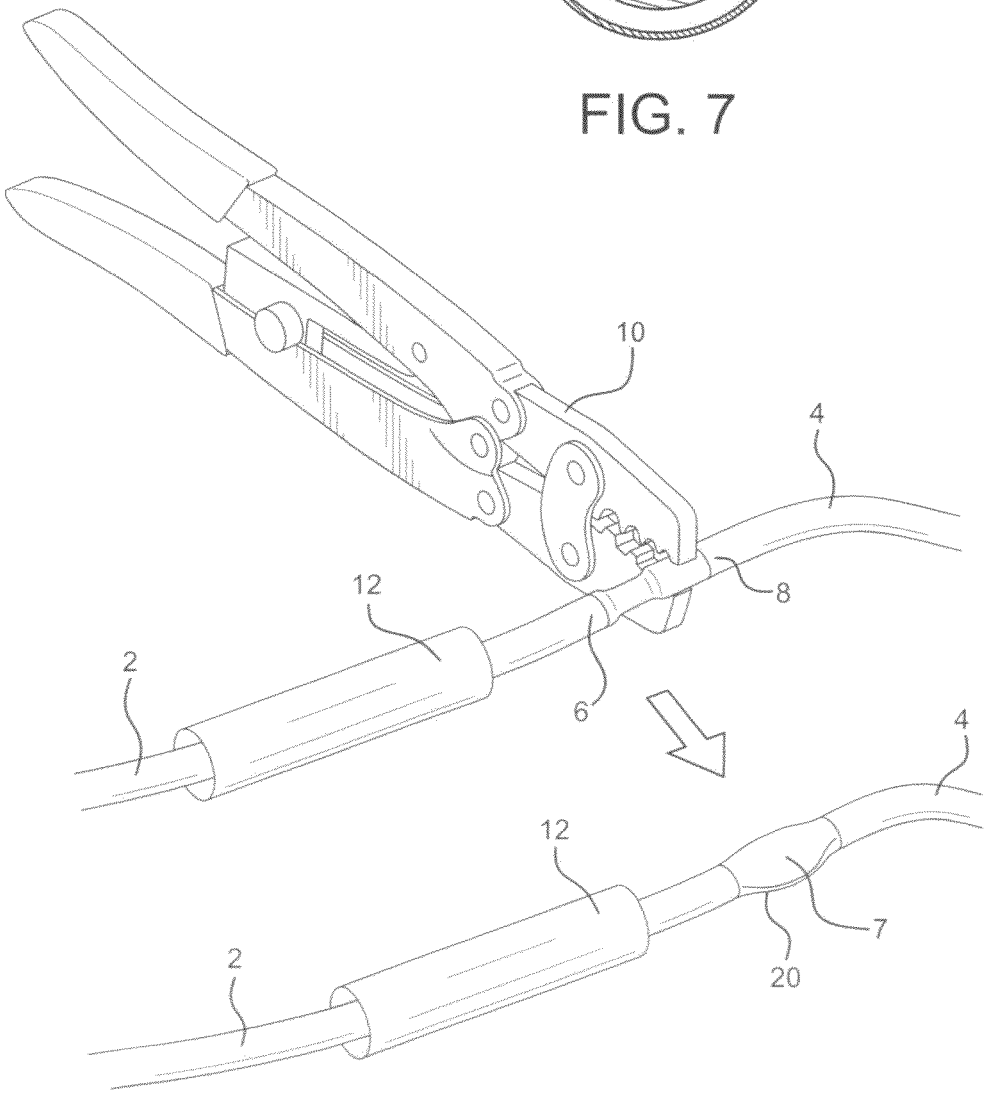
FIG. 6 shows the next steps of the method of the present invention showing the barrel members crimped over the strands of both of the ends of the lengths of wire to be connected.

Strands 5 at end 8 of wire 4 are next inserted into barrel member 7. Barrel member 7 is then similarly compressed by ratcheting crimping tool 10, such that all strands 3 and 5 at ends 6 and 8 of both wires 2 and 4 are tightly compressed to eliminate all space between the strands and the barrel member. Thus, as seen in FIG. 6, permanent connection 20 is formed between wires 2 and 4.

Figure 8:
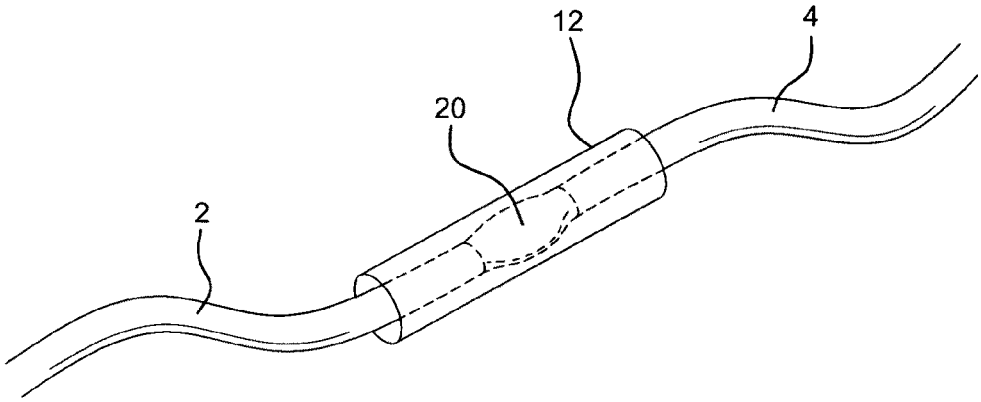
FIG. 8 shows the next step of the method of the present invention, in which the shrink tube is introduced.
Figure 9:
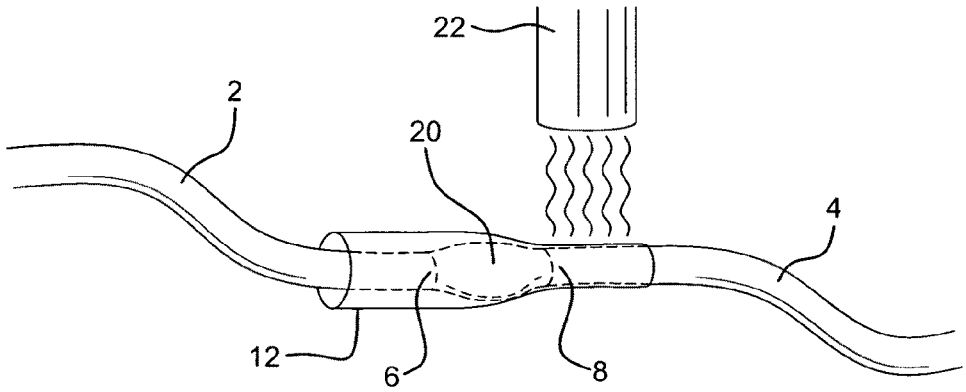
FIG. 9 shows the heating step of the method of the present invention.

Shrink tube 12 is then slid over connection 20. See FIG. 8. As shown in FIG. 9, shrink tube 12 is heated, by heat source 22, to a temperature of between 150° F. and 200° F. This causes the inner adhesive within shrink tube 12 to melt and form a permanent, void filling waterproof gasket securely around ends 6 and 8 of wires 2 and 4 and connection 20. When shrink tube 12 is further heated to approximately 230° F., the tube shrinks to about one third its size, forming an abrasion proof, tension resistant waterproof jacket, to permanently surround and protect connection 20.

It is contemplated that the method of the present invention can be used to connect 8-18 gauge stranded electrical wires which come from lighting fixtures, LED lamps, florescent lamps, and other feed power sources. However, wire of different gauges can successfully be used with this method. The type and size of the wires described herein should not be considered restrictive to the method of the invention. The herein method is directed for use with stranded wire only, for low voltage, i.e. 30 volts or less, applications.

Application of this method will result in electrical connections which can be buried in soil types ranging from acid to alkali. The connections which are made are especially important for use in the connection of current/voltage sensitive lighting sources such as LED lamps and low voltage lighting fixtures.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. The method of insulated stranded electrical wire connection comprising the steps of:

providing separate lengths of stranded electrical wire to be connected;

stripping insulation off the ends of each of said lengths of wire to expose conductor strands;

providing a shrink tube with an inner layer of adhesive located therein;

inserting the shrink tube over one of the lengths of stranded wire;

providing a metallic barrel member;

inserting the exposed conductor strands of each said lengths of wire into the barrel member;

applying constant pressure to the barrel member in distinct, irreversible, ratcheting pressure intervals to tightly compress the exposed conductor strands of each length of wire within the barrel member;

continuing to apply constant pressure to the barrel member in distinct, irreversible, ratcheting pressure intervals until all spaces between the strands and the barrel member are eliminated, forming a secure connection between said lengths of wire with no spaces between the conductor strands and the barrel member;

sliding the shrink tube over the connection between the lengths of wire;

heating the shrink tube and the layer of adhesive located therein; and continuing to heat the shrink tube and layer of adhesive located therein so as to eliminate any space between the connection and the shrink tube, forming an airtight space, void filling gasket between the connection and the shrink tube.

2. The method as in claim 1 further comprising the step of providing a waterproof ratcheting crimping tool to apply the constant pressure.

3. The method as in claim 2 comprising the further step of applying the constant pressure in distinct ratcheting intervals by use of the crimping tool.

4. The method as in claim 1 wherein the layer of adhesive is a thermoplastic adhesive.

5. The method as in claim 1 wherein the shrink tube comprises a rubberized material.

6. The method as in claim 1 wherein the shrink tube and layer of adhesive is heated to a temperature of between 150° F.-230° F.

7. The method as in claim 1 comprising the further steps of inserting the . exposed conductor strands of one of said lengths of wire into one end of the barrel member and applying constant pressure to that end of the barrel member.

8. The method as in claim 1 wherein the barrel member comprises tin coated copper.

9. The method as in claim 7 comprising the further steps of inserting the exposed conductor strands of the other of said lengths of wire into the other end of the barrel member and applying constant pressure to that other end of the barrel member to form a permanent connection between the lengths of wire.

10. The method as in claim 1 wherein in applying constant pressure the barrel member and exposed conductor strands are subjected to increasingly tightened, irreversible compression.

11. The method as in claim 10 comprising the further step of providing a ratcheting crimper to apply the increasingly tightened, irreversible compression.

* * * * *